US008951141B2

(12) United States Patent
Mizutani

(10) Patent No.: US 8,951,141 B2
(45) Date of Patent: Feb. 10, 2015

(54) IRON-TYPE GOLF CLUB SET AND IRON-TYPE GOLF CLUB HEAD SET

(71) Applicant: Dunlop Sports Co. Ltd., Kobe-shi, Hyogo (JP)

(72) Inventor: Naruhiro Mizutani, Kobe (JP)

(73) Assignee: Dunlop Sports Co. Ltd., Kobe (JP)

( * ) Notice: Subject to any disclaimer, the term of this patent is extended or adjusted under 35 U.S.C. 154(b) by 112 days.

(21) Appl. No.: 13/729,245

(22) Filed: Dec. 28, 2012

(65) Prior Publication Data

US 2013/0172096 A1 Jul. 4, 2013

(30) Foreign Application Priority Data

Dec. 29, 2011 (JP) ..... 2011-290331

(51) Int. Cl.
*A63B 53/04* (2006.01)

(52) U.S. Cl.
USPC ..... 473/291; 473/349; 473/350

(58) Field of Classification Search
CPC ..... A63B 53/047; A63B 53/0475; A63B 2053/0408
USPC ..... 473/290–291, 349, 350
See application file for complete search history.

(56) References Cited

U.S. PATENT DOCUMENTS

| | | | | |
|---|---|---|---|---|
| 5,628,698 | A * | 5/1997 | Sumitomo | 473/341 |
| 6,482,104 | B1 * | 11/2002 | Gilbert | 473/287 |
| 6,623,374 | B1 * | 9/2003 | Helmstetter et al. | 473/291 |
| 6,830,519 | B2 * | 12/2004 | Reed et al. | 473/290 |
| 6,991,559 | B2 * | 1/2006 | Yabu | 473/332 |
| 7,166,042 | B2 * | 1/2007 | Gilbert et al. | 473/350 |
| 8,574,094 | B2 * | 11/2013 | Nicolette et al. | 473/291 |
| 2010/0016095 | A1 * | 1/2010 | Burnett et al. | 473/327 |

FOREIGN PATENT DOCUMENTS

| | | |
|---|---|---|
| JP | 8-112378 A | 5/1996 |
| JP | 2001-37925 A | 2/2001 |

* cited by examiner

*Primary Examiner* — Stephen L. Blau
(74) *Attorney, Agent, or Firm* — Birch, Stewart, Kolasch & Birch, LLP

(57) ABSTRACT

A set of iron-type golf clubs and a set of iron-type golf club heads are disclosed. The loft angles of the heads are gradually increased from the lowest numbered golf club to the highest numbered golf club in the set. Given that a coefficient of inertia of the head is the ratio Ms/M of a moment of inertia Ms (gram sq·cm) of the head around a horizontal axis extending in a toe-heel direction of the head passing through the center of gravity of the head, to the mass M (g) of the head, the coefficient of inertia is gradually increased with the increase in the loft angle, and the difference of the coefficient of inertia of the head of the highest numbered club from that of the lowest numbered club is 0.3 or more.

8 Claims, 4 Drawing Sheets

IRON-TYPE GOLF CLUB SET AND IRON-TYPE GOLF CLUB HEAD SET

BACKGROUND OF THE INVENTION

The present invention relates to a set of iron-type golf clubs, more particular to a set of iron-type golf club heads in which the moment of inertia around a horizontal axis parallel to the toe-heel direction is peculiarly defined in relation to the mass of the head to improve the stability of flight distances of golf balls.

In recent years, it has been proposed to lower the center of gravity of a golf club head in order to make it easy to hit a golf ball on the upper side of a sweet spot of a club face and thereby to provide a great vertical gear effect for the hit golf ball. As a result, the amount of back spin given to the hit golf ball becomes decreased. Thus it is prevented to hit the ball high in the sky due to the back spin, and the flight distance of the golf ball can be improved.

Meanwhile, in the case of a club head having a great loft angle, ball hitting positions are apt to be varied widely in the club face toward the upper side or lower side of the sweet spot. Therefore, the amount of back spin of the hit golf ball is varied wide, which disadvantageously causes unstable flight distances.

SUMMARY OF THE INVENTION

Therefore, the present invention was made to solve such problems, and an object of the present invention is to provide a set of iron-type golf clubs and a set of iron-type golf club heads in which, flight distances of hit golf balls are stabilized and improved even in a club head having a greater loft angle.

According to the present invention, an iron-type golf club set comprises three or more iron-type golf clubs with cub heads having different loft angles such that the loft angles are gradually increased from the lowest numbered club therein having the smallest loft angle to the highest numbered club head therein having the largest loft angle, wherein coefficients of inertia (A) of the club heads are gradually increased with the increase in the loft angle, and the difference (An−A1) of the coefficient of inertia (An) of the head the highest numbered club from the coefficient of inertia (A1) of the head of the lowest numbered club is 0.3 or more, wherein the coefficient of inertia (A) of the club head is the ratio Ms/M of a moment of inertia Ms (gram sq·cm) of the club head around a horizontal axis extending in a toe-heel direction of the club head passing through the center of gravity of the club head, to the mass M (g) of the club head.

According to the present invention, an iron-type golf club head set comprises three or more iron-type golf club heads having different loft angles, wherein coefficients of inertia (A) of the club heads are gradually increased with the increase in the loft angle, and the difference (An−A1) of the coefficient of inertia (An) of the club head having the largest loft angle from the coefficient of inertia (A1) of the club head having the smallest loft angle is 0.3 or more, wherein the coefficient of inertia (A) of the club head is the ratio Ms/M of a moment of inertia Ms (gram sq·cm) of the club head around a horizontal axis extending in a toe-heel direction of the club head passing through the center of gravity of the club head, to the mass M (g) of the club head.

Therefore, the club head having the increased coefficient of inertia has a small vertical gear effect. Accordingly, even if the ball hitting position is varied wide in the vertical direction, the change in the amount of back spin is decreased, and the stability of flight distances of the golf balls hit by the club having a greater loft angle can be improved.

According to the present invention, the club heads may have the following features:

(1) Each of the club heads comprises a head main body having, on its front side, a club face for hitting a golf ball, the head main body is provided on its back side with a top side protruding part protruding backward so that the top side protruding part has an outer peripheral surface connected to an upper edge of the club face and defining an upper surface of the head main body, and an inner peripheral surface facing toward the center of gravity of the club head, wherein a thickness of the top side protruding part of each of the club heads is gradually increased with the increase in the loft angle when the thickness is measured as the difference Ho−Hi between a maximum height Ho of the outer peripheral surface and a maximum height Hi of the inner peripheral surface;

(2) In at least one of the club heads, the above-mentioned inner peripheral surface of the top side protruding part is provided with a horizontal part extending parallel with the toe-heel direction while having the maximum height Hi;

(3) The head main body is composed of a first metallic material, and a second metallic material having a specific gravity greater than that of the first metallic material and constituting at least a part of the top side protruding part;

(4) In the rear views of the club heads in their standard states, the top side protruding parts of the club heads are provided with horizontal parts each defined as extending in parallel with a toe-heel direction of the head and having the maximum height Hi, and the length L of the horizontal part is gradually increased with the increase in the loft angle β.

In this application including the description and claims, dimensions, positions, directions and the like relating to the club head refer to those under a standard state of the club head unless otherwise noted.

Here, the standard state of the club head is, as shown in FIGS. 1 to 3, such that the club head is set on a horizontal plane HP so that the axis CL of the club shaft 2 is inclined at the lie angle α while keeping the axis CL in a vertical plane VP, and the club face 5 forms its loft angle β (face angle is 0) with respect to the horizontal plane HP. Incidentally, in the case of the club head alone, the center line of the shaft inserting hole (h) can be used instead of the axis of the club shaft.

"Front-back direction" is a direction parallel with a straight line N projected on the horizontal plane HP, wherein the straight line N is drawn normally to the club face passing through the center of gravity G of the club head.

"Sweet spot" is defined as the intersecting point SS of the normal line N and the club face.

"Toe-heel direction" is a direction TK parallel with the horizontal plane HP and perpendicular to the front-back direction.

"vertical direction" is a direction TL perpendicular to the horizontal plane HP.

DESCRIPTION OF THE PREFERRED EMBODIMENTS

Embodiments of the present invention will now be described in detail in conjunction with the accompanying drawings.

According to the present invention, the iron-type golf club set includes three or more iron-type golf clubs 1 having different loft angles β. Usually about five to ten golf clubs 1 are included based on a practice. In order to have good control of a flight distance in a wide range, the smallest loft angle β in the set is preferably set in a range of from 19 to 27 degrees. And between two golf clubs having adjacent golf club numbers, it is preferred to change the loft angle β by about 3 to about 10 degrees.

In this embodiment, the lengths of the club shafts 2 of the iron-type golf clubs 1 are gradually decreased with the increase in the loft angle β.

Figure 1:
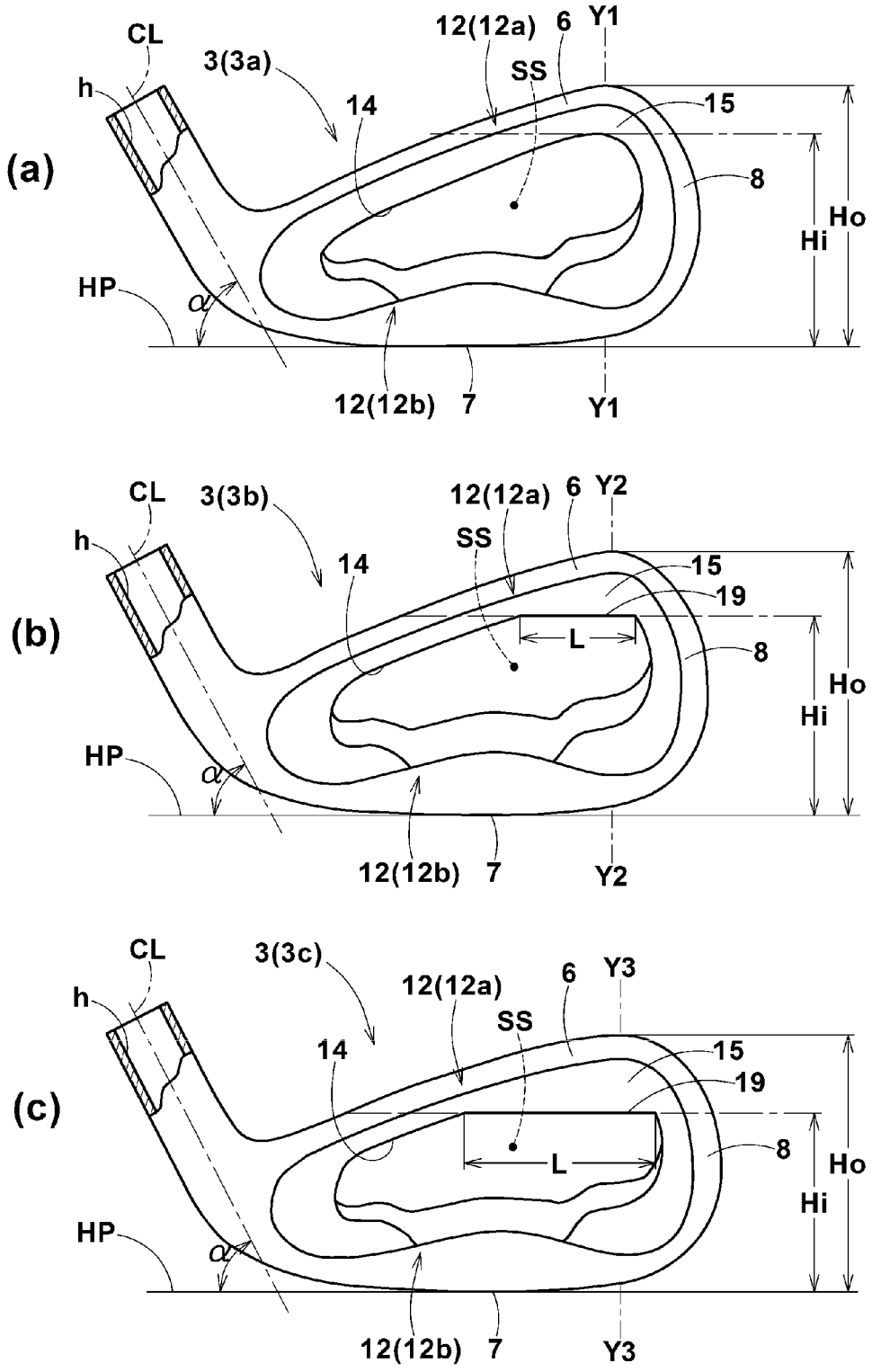
FIG. 1 shows rear views of three golf club heads (3*a*, 3*b* and 3*c*) constituting an embodiment of the present invention.

In the example shown in FIG. 1, the club head 3*a* for the lowest numbered club having the smallest loft angle β is a five iron. The club head 3*c* for the highest numbered club having the largest loft angle β is a pitching wedge. The club head 3*b* for an intermediate numbered club having an intermediate loft angle β is an eight iron. In the golf club set according to the present invention, the lowest numbered golf club head 3*a* may be a three or four iron for example. The highest numbered golf club head 3*c* may be a sand wedge or a nine iron, for example.

Given that a coefficient of inertia (A) of the golf club head 3 is a ratio Ms/M of a vertical moment of inertia Ms (gram sq·cm) of the head 3 to the mass M (g) of the head 3, a difference (An−A1) between the coefficient of inertia (A1) of the lowest numbered club head having the smallest loft angle and the coefficient of inertia (An) (n is a natural number of 3 or more) of the highest numbered club head having the largest loft angle is set to be not less than 0.3.

Thus, the coefficient of inertia (A) of the highest numbered club head is made greater than that of the lowest numbered club head to thereby decrease the vertical gear effect of the highest numbered club head. Accordingly, even if the ball hitting position is varied in the vertical direction when using the club head 3 having the largest loft angle in which the ball hitting position is apt to vary wide in the vertical direction, the change in the amount of back spin of the hit golf ball is decreased, and the stability of flight distances can be improved.

If the difference (An−A1) of the coefficient of inertia (A) is increased, the vertical gear effect is excessively decreased, which may reduce the amount of back spin of the club head 3 having the largest loft angle to make it impossible to stop the golf ball on a green which is a target point.

For this reason, the difference (An−A1) is preferably set in a range of not less than 0.5, but not more than 0.9, more preferably not more than 0.8. From the same viewpoint, the coefficient of inertia (An) of the highest numbered club head having the largest loft angle is preferably set in a range of not less than 3.1, but preferably not more than 4.0, more preferably not more than 3.9.

Thus, according to the present invention, defined for each of the club heads 3 is not merely the magnitude of the vertical moment of inertia Ms, but the ratio Ms/M of the vertical moment of inertia Ms to the mass M of the head. With this, the effect of the vertical moment of inertia Ms can be evaluated without being influenced by the magnitude of the mass of the club head 3. Furthermore, the magnitude of the vertical gear effect can be more correctly evaluated between the clubs due to the difference between the loft angles.

The coefficients of inertia (A) of the club heads 3 need to be gradually increased with the increase in the loft angle. With this, the higher numbered club head, in which the ball hitting position is more apt to be vertically deviated from the sweet spot, can more decrease the change in the amount of the back spin due to such off-center shot, therefore, the stability of flight distances of the hit golf balls can be improved.

In order to effectively derive this advantageous effect, the difference between the coefficients of inertia of the club heads having the adjacent golf club numbers is preferably set in a range of not less than 0.05 and more preferably not less than 0.10, but not more than 0.30 and more preferably not more than 0.20.

Next, the heads 3 constituting the club head set according to the present invention will be specifically described.

If the mass of the club head 3 is decreased, the vertical moment of inertia Ms and a lateral moment of inertia Mg around a vertical axis SL passing through the center of gravity G are decreased, which may deteriorate the directional stability of the hit golf ball and the stability of flight distances. On the other hand, if the mass is increased, it becomes difficult to swing through the golf ball, which may deteriorate the directional stability and flight distance of the golf ball. From these viewpoints, the weight of the club head 3 is preferably set in a range of not less than 180 g and more preferably not less than 200 g, but not more than 340 g and more preferably not more than 320 g.

In this embodiment, the heads 3 each comprise a head main body 3A having the club face 5 for hitting the golf ball on its front side, and a hosel section 3B formed continuously from a heel side of the head main body 3A. The hosel section 3B is provided with a shaft inserting hole (h) and has a substantially cylindrical shape.

The head main body 3A has the above-mentioned club face 5, a back surface 9 opposite to the club face 5, an upper surface 6 continuing to the upper edge 5*a* of the club face 5 and forming an upper surface of the head, a lower surface 7 continuing to the lower edge 5*b* of the club face 5 and forming a bottom surface of the head, and a toe-side surface 8 extending in a toe side of the head main body 3A to connect the lower surface 7 and the upper surface 6. Each of the surfaces 5 to 9 forms an outer surface of the head.

The heads 3 in this embodiment is each composed of a face plate member 10 defining at least a major part of the club face 5, and a face support member 11 holding the face plate member 10 and integrally including the hosel section 3B.

The face plate member 10 and the face support member 11 are preferably made of metallic materials. Various metallic materials, for example, titanium, titanium alloys, aluminum alloys, stainless steels, soft iron and the like may be used. Above all, the face plate member 10 is preferably made of a titanium alloy having a high specific strength and excellent resilience. The face support member 11 is preferably made of a stainless steel or soft iron, as a casting product, having a specific gravity higher than that of the face plate member 10. With this, the club head 3 can be provided, in which much weight is shifted toward the peripheral part of the face plate member 10 to have a greater vertical moment of inertia Ms, a greater lateral moment of inertia Mg and a wider sweet area.

The face plate member 10 and/or face support member 11 can be formed from not only the above-mentioned single metallic material but also two or three metallic materials. However, the head 3 may be constituted by one metallic material if desired.

The face plate member 10 and the face support member 11 are integrated with each other by joining means such as welding, soldering, caulking, an adhesive, and/or a screw.

The range of the thickness T of the face plate member 10 is not particularly limited. However, when the thickness T is too large, the resilience of the head is apt to be reduced. When the thickness T is too small, the strength of the face plate member 10 becomes insufficient, which tends to deteriorate durability. Therefore, the thickness T is preferably not less than 1.5 mm, more preferably not less than 2.0 mm, but not more than 4.5 mm, more preferably not more than 3.0 mm.

It is not essential that the thickness T is constant. The face plate member 10 may have a variable thicknesses T.

Incidentally, the club face 5 may be provided with so called face lines FL or fine grooves for enhancing a frictional force between the club face 5 and the golf ball if necessary.

Figure 2:
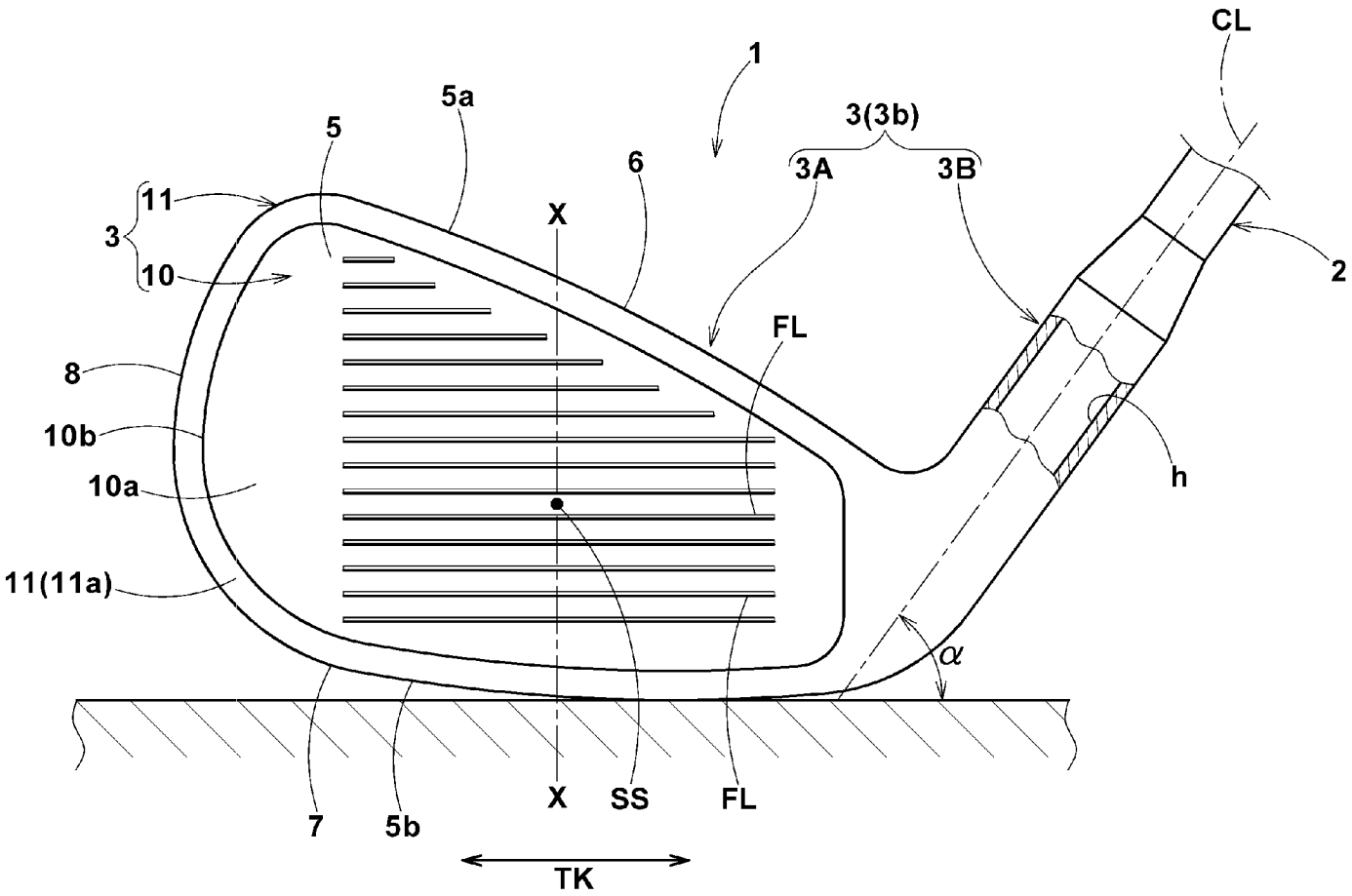
FIG. 2 is a front view of the golf club head (3*b*).
Figure 3:
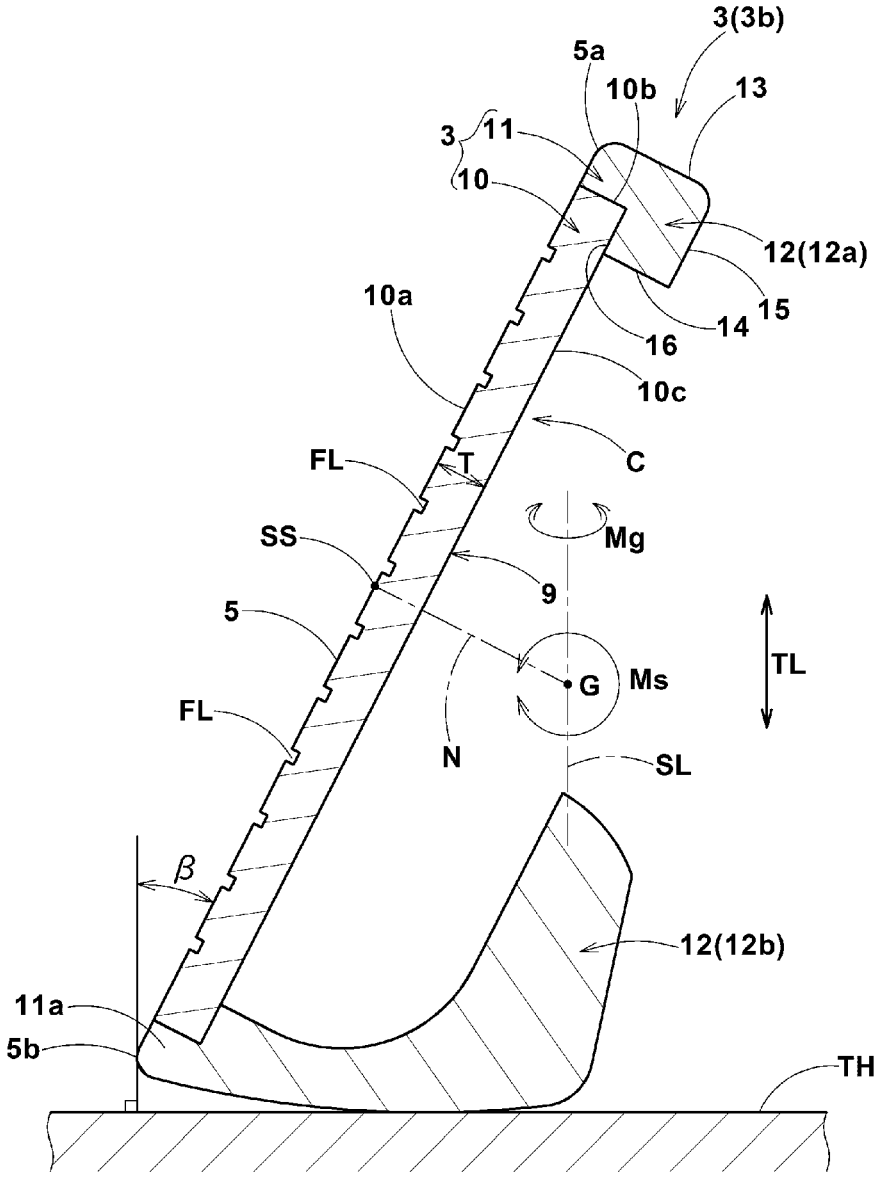
FIG. 3 is a cross sectional view taken along line x-x of FIG. 2.

In this embodiment, as shown in FIGS. 2 and 3, the face plate member 10 is a substantially flat plate having a front surface 10*a* forming the club face 5, a back surface 10*c* opposite to the front surface 10*a*, and an outer peripheral surface 10*b* extending therebetween.

In this embodiment, the face support member 11 is provided with a through-hole penetrating through the face support member 11 in the front-back direction to expose the back surface 10*c* of the face plate member 10.

The face support member 11 comprises a receiving frame 11*a* integrated with the hosel section 3B. The receiving frame 11*a* extends annularly around the through-hole to support the whole of the outer peripheral surface 10*b* and a peripheral part of the back surface 10*c*. In this embodiment, therefore, the outer peripheral surface 10*b* is not exposed. But, according to the present invention, the face plate member 10 is not limited to such arrangement. it is possible to expose a part of the outer peripheral surface.

As a result, the head main body 3A is provided with a backward protruding part 12 protruding backwardly from the back surface 10*c* and surrounding the through-hole.

Thus, the head 3 is provided on the back surface 9 side with a back cavity C opened toward the backside and accordingly recessed toward the club face 5 side.

Such cavity back structure having the backward protruding part 12 is helpful to shift much weight backward from the club face 5, and to increase the moments of inertia Ms and Mg in order to stabilize flight distances and directional stability of the golf balls.

The backward protruding part 12 includes a top side protruding part 12*a* and a sole side protruding part 12*b* which extend continuously to surround the sweet spot SS.

The top side protruding part 12*a* is defined as being located above the sweet spot SS and extends along the upper surface 6 and a part of the toe-side surface 8.

The sole side protruding part 12*b* is defined as extending from the top side protruding part 12*a* along the lower surface 7 of the head main body 3A.

Figure 4:
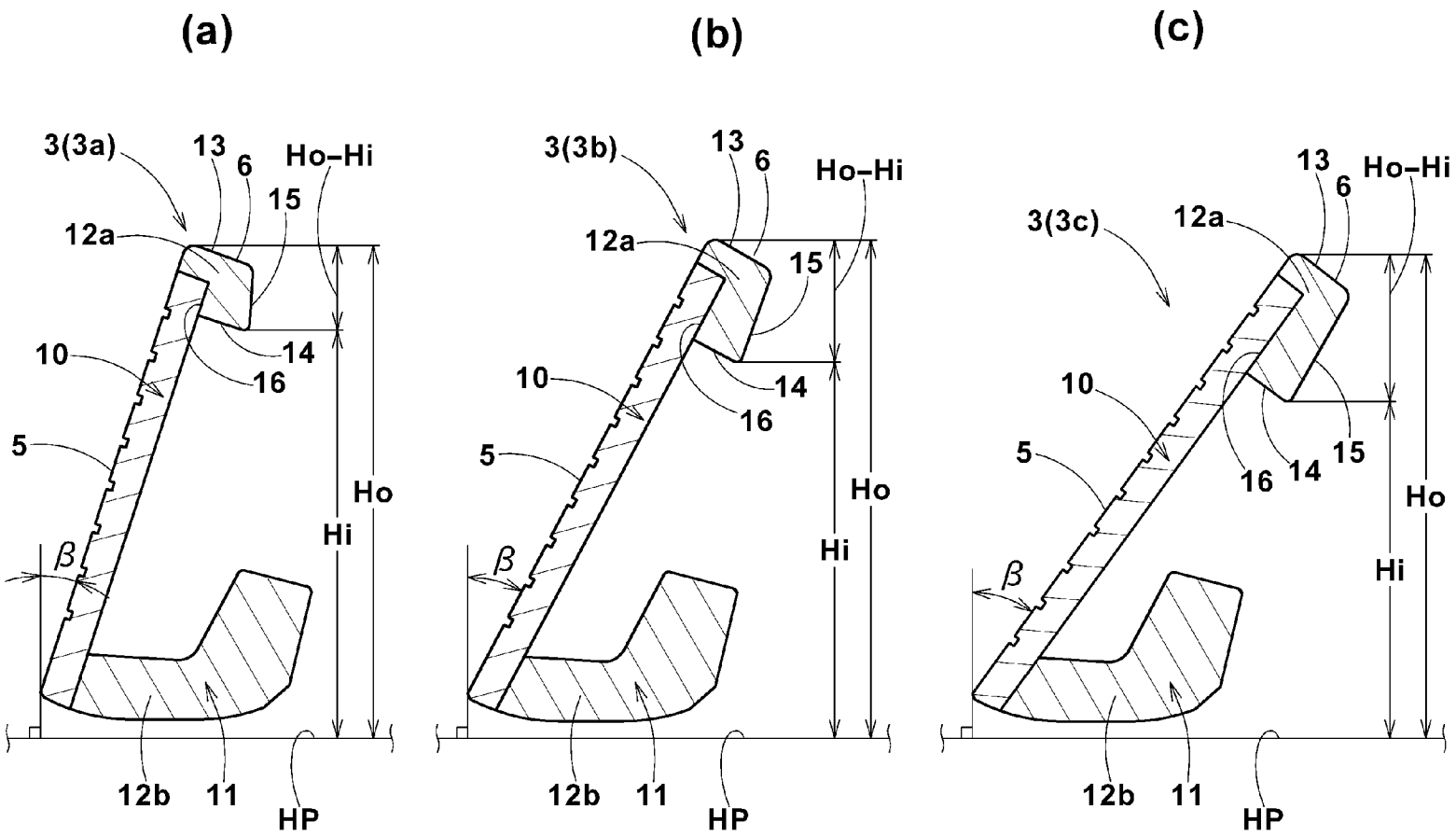
FIG. 4 shows cross sections of the three golf club heads (3*a*, 3*b* and 3*c*) taken along lines Y1-Y1, Y2-Y2 and Y3-Y3 in FIG. 1, respectively.

In this embodiment, as shown in FIGS. 3 and 4, the top side protruding part 12*a* has an outer peripheral surface 13 extending backward from the upper edge 5*a* of the club face 5, an inner peripheral surface 14 extending backward from the back surface 9 (on the center of gravity side of the upper edge 5*a*) so as to face toward the center of gravity G, a back side surface 15 extending between the inner peripheral surface 14 and the outer peripheral surface 13 on the back side of the head. and a connect surface 16 connected to the back surface 10*c*.

It is preferable that, as shown in FIG. 4, a thickness Ho−Hi of the backward protruding part 12 is gradually increased with the increase in the loft angle β.

Here, the thickness Ho−Hi is a difference between the maximum height Ho of the outer peripheral surface 13 and the maximum height Hi of the inner peripheral surface 14 which are measured in the rear view of the head in its standard state, from the horizontal plane HP.

Therefore, in a vertical cross section of the head parallel to the front-back direction, if the inner peripheral surface 14 is inclined as shown in FIG. 4, there is a possibility that the maximum height Hi occurs at the lowermost edge of the surface 14 in the vertical cross section.

When the protruding part thickness Ho−Hi is increased, the mass of the head 3 located on the outer peripheral surface 13 side increases, and the vertical moment of inertia Ms is increased. This increases the coefficient of inertia (A), and reduces the vertical gear effect. Therefore, the stability of flight distances of the hit golf ball can be improved. However, when the protruding part thickness Ho−Hi is excessively increased, the maximum height Hi of the inner peripheral surface is decreased, which may instead reduce the vertical moment of inertia Ms.

For this reason, preferably, the protruding part thickness Ho−Hi is set in a range of not less than 5%, more preferably not less than 10%, but not more than 70% and more preferably not more than 60% of the maximum height Ho of the outer peripheral surface 13.

At least one or two or more of the club heads 3 is/are each provided in the top side protruding part 12*a* with a horizontal part 19. The horizontal part 19 is defined as extending in parallel with the toe-heel direction in the rear view of the head in its standard state, and having the above-mentioned maximum height Hi.

In this embodiment, as shown in FIG. 1, the length L of the horizontal part 19 is gradually increased with the increase in the loft angle β.

The smallest length L of the horizontal part 19 in the club head having the smallest loft angle is usually set to be 5 mm or more, but it is also possible to set at almost zero.

The top side protruding part 12*a* having such horizontal part 19 can suppress the excessive increase in the mass of the head 3 and effectively increase the vertical moment of inertia Ms. Therefore, the top side protruding part 12*a* is useful to enhance the coefficient of inertia (A).

In this embodiment, the sole side protruding part 12*b* of each head is provided with a rising part having a relatively larger thickness and rising from the sole while keeping a distance from the back surface 10*c* of the face plate member 10, therefore, the center of gravity G is lowered and deepened.

In order to increase the coefficient of inertia (A) and thereby to decrease the change in the amount of back spin, preferably, the head main body 3A comprises a first metallic material and a second metallic material, wherein the second metallic material has a specific gravity greater than that of the first metallic material and constitutes at least a part of the top side protruding part 12*a*.

It is preferable that the first metallic material constitutes a major part of the face support member 11.

In this example, the first metallic material is used to form a part of the face support member 11 below the maximum height Hi of the inner peripheral surface 14. And the second metallic material is used to form a part of the face support member 11 above the maximum height Hi of the inner peripheral surface 14. The position of the second metallic material is not limited to this example. For example, it is possible or preferable that the second metallic material is used to form a part of the sole side protruding part 12*b*, in particular in a place near the sole. with this, the vertical moment of inertia Ms is further improved.

Preferably, the first metallic material is, as described above, a casting product of a stainless steel or soft iron constituting a major part of the face support member 11. Preferably, the second metallic material is tungsten or a tungsten alloy.

Incidentally, it is preferable that the hosel section 3B is made of one kind of the first metallic material.

As described above, the present invention has been described in detail. However, the present invention can be modified variously if necessary, without being limited to the above-mentioned specific embodiment.

Comparison Tests

In order to confirm the effects of the present invention, iron-type golf clubs based on FIGS. 1 to 4 were experimentally produced and tested for the stability of flight distances of the hit golf balls and whether it is easy to hit the ball high.

Excluding parameters shown in Table 1, all of the heads had the same specifications. Common specifications are as follows:

Mass and length of shaft: common to all golf clubs having the same golf club number Face plate member: a titanium alloy (specific gravity: 4.4)

Face support member: a stainless steel (specific gravity: 7.8)

<Flight Distance Stability Test>

Each of ten right-handed golfers having handicaps 5 to 25 hit ten golf balls using each of the clubs. And the difference of the flight distance of the hit golf ball from the intended position (distance) was evaluated into ten ranks by the golfer's sense. The average evaluation of the ten golfers is shown in Table 1 as the test result, wherein the higher the rank number, the better the stability.

<High Shot Test>

About whether it is easy to hit the ball high, the above-mentioned ten golfers evaluated the golf clubs into ten ranks. The average evaluation of the ten golfers is shown in Table 1 as the test result. The higher the rank number is, the easier the golfer hit the ball high into the air.

From the test result, it was confirmed that the stability of flight distances in the iron-type golf club sets according to the invention can be improved as compared with the iron-type golf club sets as Comparative Examples.

TABLE 1

| Head | Ref. 1 | Ex. 1 | Ex. 2 | Ex. 3 | Ex. 4 | Ex. 5 | Ex. 6 | Ex. 7 | Ex. 8 | Ref. 2 |
|---|---|---|---|---|---|---|---|---|---|---|
| Mass M of club head (g) | | | | | | | | | | |
| #5 iron | 254 | 248 | 248 | 248 | 248 | 248 | 248 | 248 | 248 | 248 |
| #7 iron | 269 | 261 | 261 | 261 | 261 | 261 | 261 | 261 | 261 | 261 |
| #8 iron | 275 | 269 | 269 | 269 | 269 | 269 | 269 | 269 | 269 | 269 |
| Pitching wedge | 291 | 281 | 281 | 281 | 281 | 281 | 281 | 281 | 281 | 281 |
| Coefficient of inertia (g sq · cm/g) | | | | | | | | | | |
| #5 iron | 2.65 | 2.94 | 3.07 | 2.94 | 2.94 | 2.94 | 3.19 | 3.07 | 2.79 | 2.41 |
| #7 iron | 2.65 | 3.16 | 3.17 | 3.37 | 3.41 | 3.19 | 3.41 | 3.33 | 2.86 | 2.44 |
| #8 iron | 2.69 | 2.26 | 3.20 | 3.55 | 3.62 | 3.30 | 3.55 | 3.51 | 2.91 | 2.45 |
| Pitching wedge | 2.68 | 2.46 | 3.37 | 3.83 | 4.01 | 3.41 | 4.1 | 3.9 | 3.1 | 2.66 |
| Difference An − A1 (g sq · cm/g) | 0.03 | 0.52 | 0.3 | 0.89 | 1.07 | 0.47 | 0.91 | 0.83 | 0.31 | 0.25 |
| Length L of horizontal part (mm) | | | | | | | | | | |
| #5 iron *1 | — | + | + | + | + | + | + | + | + | + |
| #7 iron | — | 20 | 30 | 33 | 34 | 30 | 34 | 33 | 20 | 15 |
| #8 iron | — | 25 | 33 | 38 | 39 | 35 | 38 | 38 | 25 | 20 |
| Pitching wedge | — | 40 | 38 | 45 | 47 | 38 | 48 | 47 | 35 | 30 |
| Stability of flight distances | 3 | 7 | 5 | 5.5 | 4.5 | 6.5 | 5 | 5.5 | 5 | 3.5 |
| Whether it is easy to hit ball high | 6 | 6 | 6 | 5.5 | 5.5 | 6 | 5.5 | 5.5 | 6 | 6 |

*1 "+" plus sigh means a positive length less than 5 mm

The invention claimed is:

1. An iron-type golf club set comprising three or more iron-type golf clubs with cub heads having different loft angles such that the loft angles are gradually increased from the lowest numbered golf club therein having the smallest loft angle to the highest numbered golf club therein having the largest loft angle, wherein coefficients of inertia (A) of the club heads are gradually increased with the increase in the loft angle, and the difference (An−A1) of the coefficient of inertia (An) of the club head of the highest numbered club from the coefficient of inertia (A1) of the club head of the lowest numbered club is 0.3 or more, wherein:

the coefficient of inertia (A) of the club head is the ratio Ms/M of a moment of inertia Ms (gram sq·cm) of the club head around a horizontal axis extending in a toe-heel direction of the club head passing through the center of gravity of the club head, to the mass M (g) of the club head, each of the club heads comprises a head main body having, on its front side, a club face for hitting a golf ball, the head main body is provided on its back side with a top side protruding part protruding backward so that the top side protruding part has an outer peripheral surface connected to an upper edge of the club face and defining an upper surface of the head main body, and an inner peripheral surface facing toward the center of gravity of the club head, and thicknesses of the top side protruding parts of the club heads are gradually increased with the increase in the loft angle when each said thickness is measured as the difference Ho−Hi between a maximum height Ho of the outer peripheral surface and a maximum height Hi of the inner peripheral surface in the rear view of the club head in its standard state.

2. The iron-type golf club set according to claim 1, wherein in at least one of the club heads, the inner peripheral surface of the top side protruding part is provided with a horizontal part extending parallel with the toe-heel direction while having the maximum height Hi.

3. The iron-type golf club set according to claim 1, wherein the head main body is composed of a first metallic material, and a second metallic material having a specific gravity larger than that of the first metallic material and constituting at least a part of the top side protruding part.

4. The iron-type golf club set according to claim 1, wherein in the rear views of the club heads in their standard states, the top side protruding parts of the club heads are provided with horizontal parts each defined as extending in parallel with a toe-heel direction of the head and having the maximum height Hi, and the length L of the horizontal part is gradually increased with the increase in the loft angle β.

5. An iron-type golf club head set comprising three or more iron-type golf club heads having different loft angles, wherein coefficients of inertia (A) of the club heads are gradually increased with the increase in the loft angle, and the difference (An−A1) of the coefficient of inertia (An) of the club head having the largest loft angle from the coefficient of inertia (A1) of the club head having the smallest loft angle is 0.3 or more, wherein:

the coefficient of inertia (A) of the club head is the ratio Ms/M of a moment of inertia Ms (gram sq·cm) of the club head around a horizontal axis extending in a toe-heel direction of the club head passing through the center of gravity of the club head, to the mass M (g) of the club head, each of the club heads comprises a head main body having, on its front side, a club face for hitting a golf ball, the head main body is provided on its back side with a top side protruding part protruding backward so that the top side protruding part has an outer peripheral surface connected to an upper edge of the club face and defining an upper surface of the head main body, and an inner peripheral surface facing toward the center of gravity of the club head, and thicknesses of the top side protruding parts of the club heads are gradually increased with the increase in the loft angle when each said thickness is measured as the difference Ho−Hi between a maximum height Ho of the outer peripheral surface and a maximum height Hi of the inner peripheral surface in the rear view of the club head in its standard state.

6. The iron-type golf club set according to claim 5, wherein the head main body is composed of a first metallic material, and a second metallic material having a specific gravity larger than that of the first metallic material and constituting at least a part of the top side protruding part.

7. The iron-type golf club set according to 5, wherein in at least one of the club heads, the inner peripheral surface of the top side protruding part is provided with a horizontal part extending parallel with the toe-heel direction while having the maximum height Hi.

8. The iron-type golf club set according to 5, wherein in the rear views of the club heads in their standard states, the top side protruding parts of the club heads are provided with horizontal parts each defined as extending in parallel with a toe-heel direction of the head and having the maximum height Hi, and the length L of the horizontal part is gradually increased with the increase in the loft angle β.

* * * * *